US007611332B2

(12) United States Patent
Hofmann et al.

(10) Patent No.: US 7,611,332 B2
(45) Date of Patent: Nov. 3, 2009

(54) DEVICE AND METHOD FOR CONTROLLING A THICK MATTER PUMP

(75) Inventors: Wilhelm Hofmann, Niederdorfelden (DE); Werner Münzenmaier, Nürtingen (DE)

(73) Assignee: Putzmeister Concrete Pumps GmbH, Aichtal (DE)

( * ) Notice: Subject to any disclaimer, the term of this patent is extended or adjusted under 35 U.S.C. 154(b) by 727 days.

(21) Appl. No.: 10/558,939

(22) PCT Filed: Mar. 18, 2005

(86) PCT No.: PCT/EP2005/002896

§ 371 (c)(1),
(2), (4) Date: Dec. 1, 2005

(87) PCT Pub. No.: WO2005/093253

PCT Pub. Date: Oct. 6, 2005

(65) Prior Publication Data

US 2006/0245943 A1 Nov. 2, 2006

(30) Foreign Application Priority Data

Mar. 26, 2004 (DE) ..... 10 2004 015 419

(51) Int. Cl.
*F04B 49/12* (2006.01)
*F04B 49/22* (2006.01)
*F04B 17/00* (2006.01)

(52) U.S. Cl. ..... 417/26; 417/28; 417/46; 417/53; 417/342; 417/900

(58) Field of Classification Search ..... 417/26, 417/28, 46, 342, 347, 900, 53
See application file for complete search history.

(56) References Cited

U.S. PATENT DOCUMENTS

| | | | | |
|---|---|---|---|---|
| 4,569,642 | A * | 2/1986 | Dwyer | 417/516 |
| 5,127,806 | A * | 7/1992 | Benckert | 417/279 |
| 5,209,649 | A | 5/1993 | Dose et al. | |
| 5,238,371 | A * | 8/1993 | Benckert | 417/345 |
| 5,330,327 | A | 7/1994 | Anderson | |
| 5,332,366 | A * | 7/1994 | Anderson | 417/63 |
| 5,344,290 | A | 9/1994 | Benckert | |
| 5,388,965 | A | 2/1995 | Fehn | |
| 5,401,140 | A | 3/1995 | Anderson | |
| 5,520,521 | A * | 5/1996 | Benckert et al. | 417/280 |
| 6,171,075 | B1 | 1/2001 | Muenzenmaier et al. | |

* cited by examiner

*Primary Examiner*—Charles G Freay
(74) *Attorney, Agent, or Firm*—Patent Central LLC; Stephan A. Pendorf

(57) ABSTRACT

A device and a method for controlling a two-cylinder thick matter pump to achieve a reliable operation even of single-circuit two-cylinder thick matter pumps. To this end, the pipe switch includes a position transmitter responding to the pivoting position. At least two cylinder switching sensors are arranged on the working cylinders at a distance from each other, responding to the passing pistons of the drive cylinder, and/or a pressure sensor responding to the pressure course at the high-pressure outlet of the reversible pump is provided. A computer-assisted reversing device has a control routine responding to output signals of the position transmitter and to output signals of the cylinder switching sensors and/or the pressure sensors, enabling the programmed control of a control body for adjusting the flow quantity and direction of the reversible pump, and a reversing element arranged in the hydraulic branch of the pipe switch.

8 Claims, 3 Drawing Sheets

DEVICE AND METHOD FOR CONTROLLING A THICK MATTER PUMP

CROSS REFERENCE TO RELATED APPLICATION

This application is a national stage of PCT/EP2005/002896 filed Mar. 18, 2005 and based upon DE 10 2004 015 419.8 filed Mar. 26, 2004 under the International Convention.

BACKGROUND OF THE INVENTION

1. Field of the Invention

The invention concerns a device and a process for controlling a thick matter pump with two conveyor cylinders communicating via end openings in a material supply container, operable in counter stroke by hydraulic drive cylinders controlled by a hydraulic reversible pump, with a hydraulic actuated pipe switch provided within the material supply container, of which the inlet side is alternatingly connectible to one of the openings of the conveyor cylinders leaving open the respective other opening and on the outlet side is connected with a conveyor line, wherein the drive cylinders are respectively connected at their one end via a hydraulic line with a connection of the reversible pump and on their other end are hydraulically connected with each other via an oscillating oil line, and with a device for reversing the reversible pump and the pipe switch after completion of each piston stroke.

2. Related Art of the Invention

A device for control of a two cylinder thick matter pump of this type is known (DE 195 42 258), in which the end position of the piston of the drive cylinder can be determined by means of cylinder switch sensors for producing end position signals. The reversal of the flow-through of the reversible pumps is there initiated by the end position signal of the drive cylinder. At the same time the pipe switch is reversed. This type of pump control functions reliably, when the drive cylinder on the one hand and the drive cylinder of the pipe switch on the other hand are provided in two hydraulic circuits, when for example the pipe switch is controllable via a pressure accumulator charged by the hydraulic pump separate from the hydraulic circuit of the drive cylinder. In the so-called single circuit pumps, in which the pressure fluids for the reversing of the pipe switch are branched off directly from the hydraulic circuit of the drive cylinders supplied by the reversible pump, there may result, above all in the case of variations of the conveyed amounts and the consistency of the conveyed material, interruptions or interference when the pistons have not reached their end position and the reversing of the pipe switch already is initiated. Added to this is that the pipe switch movement in this case is carried out without shock damping, and banging and bottoming-out noises occur when the piston impacts the cylinder end.

SUMMARY OF THE INVENTION

Beginning therewith it is the task of the present invention to develop a process for controlling a two-cylinder thick matter pump, which even in the case of a single circuit pump and in the case of varying concrete consistency and pressure, makes possible a reliable and cushioned or subdued running of the pipe switch reversal.

The invention is based primarily upon the idea, that not only the pistons in the drive cylinders but also the pipe switch are to be monitored in the course of their movement and are to be reversed with computer assistance taking into consideration the measured temporal displacement course. In order to accomplish this, it is proposed in accordance with the invention that the pump-side hydraulic connections of the drive cylinder and the reversing cylinder of the pipe switch are in parallel connected branches of one of the reversible pump supplied hydraulic circuits, that the pipe switch includes a position indicator sensing its pivot position, that at least two cylinder switch sensors are provided spaced apart from each other on the drive cylinders, sensing the pistons of the drive cylinders as they pass by, and/or a pressure sensor is provided sensitive to the pressure sequence at the high pressure output of the reversible pump, and that the computer supported reversing device includes a control routine responsive to the output signal of the position provider on the one hand and to the output signal of the cylinder switch sensors and/or the pressure sensor on the other hand for a program-controlled activation of a control element for adjusting the flow-through amount and/or direction of the reversible pump, as well as a reversing element provided in the hydraulic branch of the pipe switch. The position provider of the pipe switch is therein preferably an angle provider, of which the output signal is a measure for the pivot angle of the pipe switch.

In a further preferred embodiment of the invention, the control element is the diagonal disk of the reversible pump and the diagonal disk is hydraulically or electromechanically actuatable. The reversing element of the pipe switch can be for example in the form of an electromagnetic or hydraulic controllable directional valve.

With the inventive means it is possible to conduct the process such that during the reversing process the pivot position of the pipe switch is monitored, that during the concrete conveyance process the position of the piston in the drive cylinders is monitored and that in an end-segment of each piston stroke the piston speed is slowed down by reducing the conveyance amount as controlled by the reversible pump such that piston is moved with less speed towards the end position, that in the case of impact of the piston the pressure supply to the actuating element of the pipe switch is reversed and the conveyed amount supplied by the reversible pump in the increase or push-over phase is increased without reversing direction, until the pipe switch has reached a defined intermediate position in its pivot path, that subsequently the conveyed amount supplied by the reversible pump is returned, until the pipe switch reaches an end terminus or makes contact, and that then the flow-through direction of the reversible pump is reversed and the pressure supply to the pipe switch is interrupted via the reversing element or else is maintained by switching.

A preferred embodiment of the invention envisions that in the subsequent flow-through reversal of the reversible pump a hydraulic reversing control element connected with a pipe switch is reversed or blocked. The reversible pump can for a short time be controlled to a maximal supply amount in the increasing or rising phase during the reversing process.

BRIEF DESCRIPTION OF THE DRAWINGS

In the following the invention will be described in greater detail on the basis of an illustrative embodiment shown in schematic manner in the figure. There is shown in FIG. 1 a segment from a two cylinder thick matter pump in partial sectional perspective representation.

DETAILED DESCRIPTION OF THE INVENTION

Figure 1:
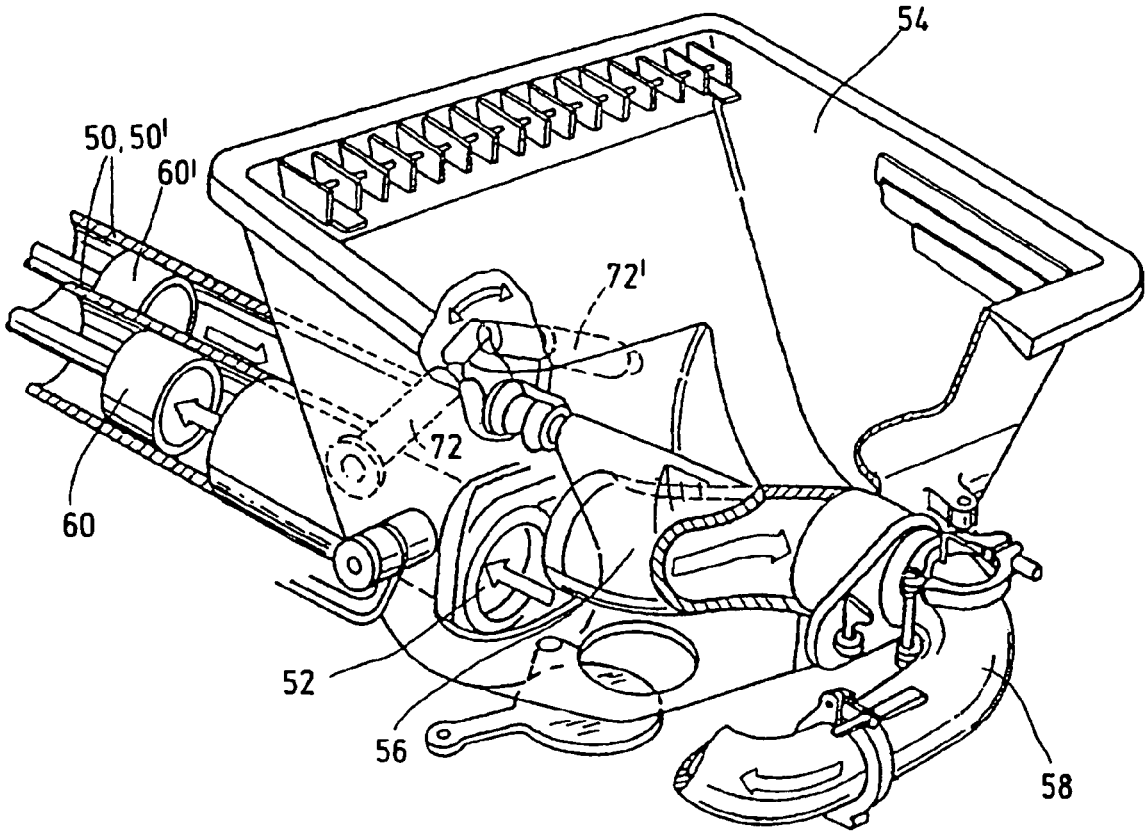
Figure 2:
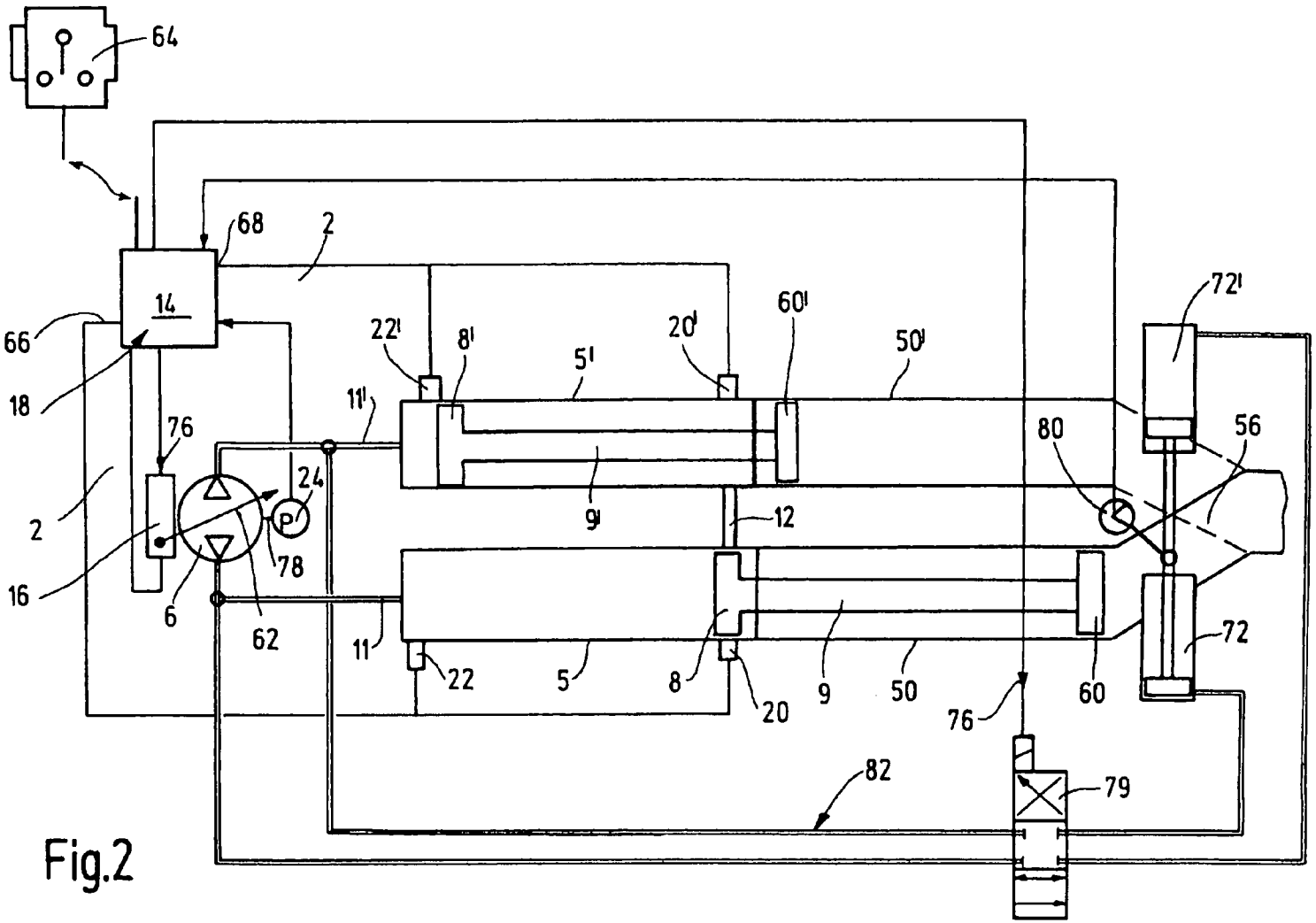
FIG. 2 a circuit diagram of a computer supported control device for a single circuit two cylinder thick matter pump.

The control device shown schematically in FIG. 2 is intended for a thick matter pump, according to FIG. 1, which includes two conveyor cylinders 50, 50' of which the end openings 52 communicate in a material supply container 54 and alternatingly during the pressure stroke can be connected with a conveyor line 58 via a pipe switch 56. The conveyor cylinders 50, 50' are operated in counter stroke via hydraulic drive cylinders 5, 5' and a reversing hydraulic pump 6. For this purpose the conveyor pistons 60, 60' of the conveyor cylinder 50, 50' are each respectively connected with a piston 8, 8' of the drive cylinder 5, 5' via a common piston rod 9, 9'.

The drive cylinders 5, 5' are acted upon with hydraulic pressure in the shown illustrative embodiment on the base side via hydraulic lines 11, 11' of the hydraulic circulation with the aid of the reversible pump 6 and are on their rod side end connected hydraulically with each other via an oscillating oil line 12. The flow-through direction of the reversible pump 6 and the direction of movement of the drive pistons 8, 8' and therewith the common piston rods 9, 9' are reversed by a reversing device 18 comprising a computer 14 and a switch mechanism 16. The reversible pump 6 has, for this purpose, a slant disk 62, which during reversing is pivoted through its zero position, so that the conveyor device reverses the oil pressure in the hydraulic lines 11, 11'. The conveyed amount of the reversible pump 6 can be varied while maintaining a predetermined rotational speed of a not-shown drive motor by changing the pivot angle of the slant disk 62. The pivot angle of the slant disk 62 can therein be adjusted via a remote control device 64 with the assistance of a computer 14.

The reversing of the reversible pump and the pipe switch 56 occurs as soon as the piston 8, 8' of the drive cylinders 5, 5' reach their end position. The reversing device evaluates output signals of the respective cylinder switch sensors 20, 22 and 20', 22' provided spaced apart from the rod side end and the base side end of the two drive cylinders 5, 5', which on the output side are connected with the computer supported reversing device 18. The cylinder switch sensors are sensitive to the drive pistons 8, 8' passing by during operation of the pump, and signal this event to the computer input 66, 68. Upon occurrence of the output signal and following a time delay the reversing device initiates a reversing signal, which reverses the reversible pump 6 via the actuating mechanism 16. In the course of the reversing process there is triggered besides this the reversing of the pipe switch 56 via the directional valve 79 and the reversing cylinder 72, 72'. In normal operation it is primarily the signals of the rod side cylinder switch sensors 20, 20' that are used for producing a reversing signal. For this, the computer 14 is programmed with a reversing routine, in which the output signals of the rod-side cylinder switch sensors 20, 22' are evaluated with formation of a reverse signal for the reversible pump 6 and/or the pipe switch 56. For the case that at least one of the rod side cylinder switch sensors 20, 20' fails, there is substituted in their place at least one of the base side cylinder switch sensors 20, 22' for generating the reverse signal for the switch routine.

The reversing device 18 further includes a pressure sensor 24, which is connected on high pressure side 78 of the reversible pump 6, and of which the output signal is evaluated in the computer with the aid of a pressure monitoring routine. The pressure monitoring routine derives in the course of a stroke process and average high pressure and includes an algorithm for determining a pressure increase occurring at the end of each conveyance stroke and for the conversion thereof into a reversal signal for the reversible pump 6 and/or the pipe switch 56. This reversing signal is the preferred signal for reversing in the case of a failure of the cylinder switch sensors 20, 20', 22, 22'.

One special feature of the invention is comprised therein, that the pipe switch 56 includes a position indicator 80 responsive to the pivot angle or pivot position, and that the computer supported reversing device 18 includes a control routine responsive to the position indicator 80 as well as the output signal of the cylinder switch sensors 20, 20', 22, 22' and/or the pressure sensor 24 for providing a programmed control of the diagonal disk 62 of the reversible pump 6 as well as providing control of a reversing element 79 provided in the hydraulic branch 82 of the pipe switch 56. In the shown illustrative embodiment the position indicator 80 is in the form of an angle transmitter, while the reversing element 79 is in the form of an electromagnetic controllable directional valve.

Thereby the pipe switch 56 can be acted upon with hydraulic oil depending upon its angular position, so that a rapid, however still dampened or softened carrying out of the reversing movement occurs.

Figure 3:
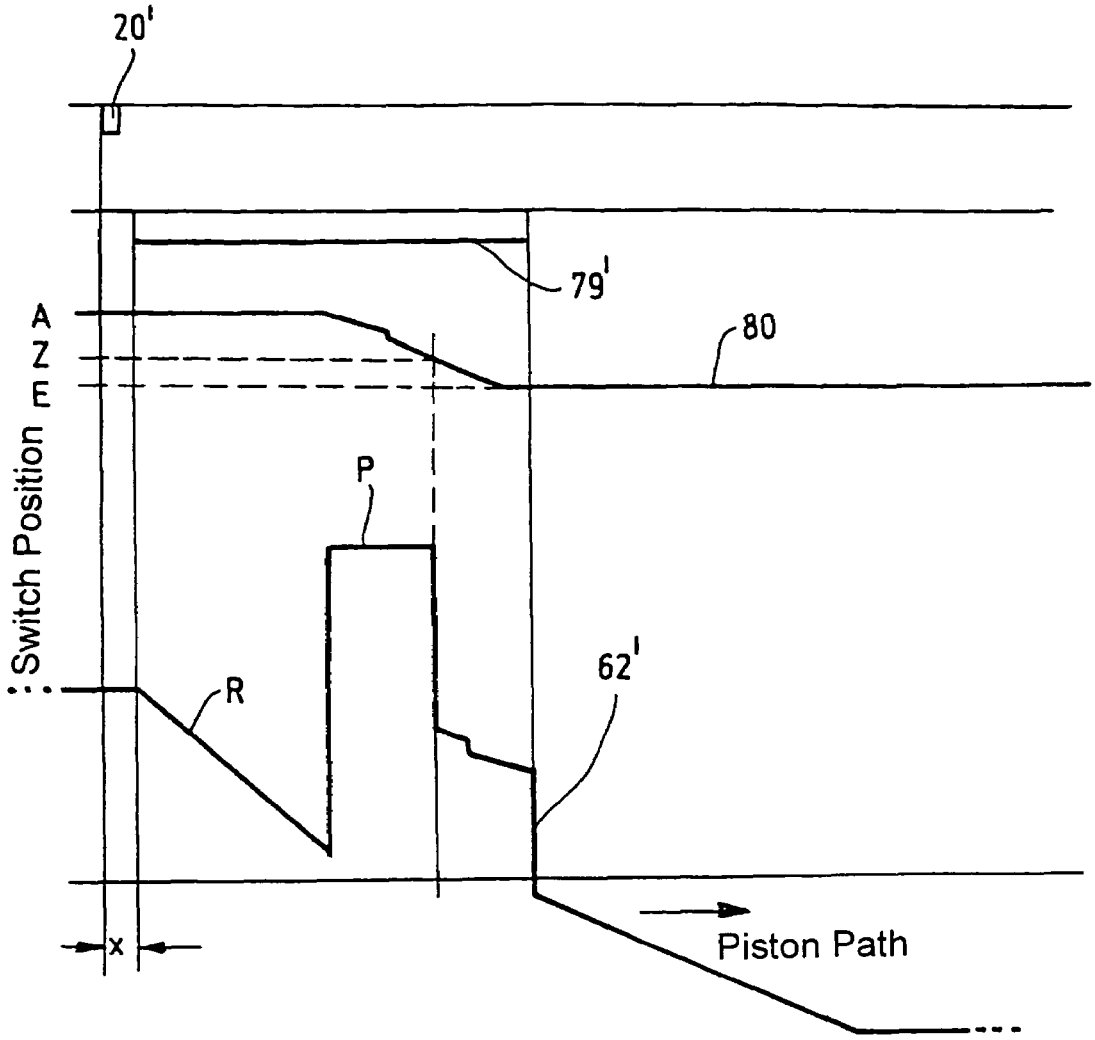
FIG. 3 a diagram for illustrating the reversing process of the reversible pump and pipe switch at the end of each piston strokes.

In the following the reversing process of the pipe switch which is described in greater detail on the basis of the diagram according to FIG. 3. Plotted in the upper diagram as a function of time are the switch position 79' of the reversing valve 79, in the center diagram the angle position 80' of the angle sensor 80 and in the lower diagram the angular position 62' of the diagonal disk 62 of the reversible pump 6. Further, there are indicated the points at which the rod side cylinder switch sensors 20 and 20' are addressed by the passing pistons 8, 8' and provide a reversing signal. After the occurrence of the reversing signal at the cylinder switch sensors the piston first travels delay distance or section x while waiting for the delay or lag in response, the length depending upon conveyance output or as the case may be stroke duration, until the diagonal disk 62 is controlled by the reversible pump 18. The delay provides a ramp in the conveyance amount, which leads to a braking or slowing down of the piston 8, 8'. At the end of the brake ramp the piston is standing still at the cylinder base. From thereon the diagonal disk 62 pivots again completely into a pushover phase P, so that a pressure is built up in the until now direction of advance, which causes the pipe switch 56 to move out of its starting position A. After the pipe switch has passed a predetermined intermediate position Z, which is signaled by a position sensor 80, the diagonal disk 62 is again pivoted back. The supply of the cylinders 70 or as the case may be 72' of the pipe switch are finally stopped when the end position E of the pipe switch is reached. In this case the directional valve 79 moves to its neutral intermediate position. Finally, the diagonal disk is completely pivoted so that the return stroke can occur.

The described process is of particular advantage for a single circuit two cylinder thick matter pump, in which the pump side hydraulic connections of the drive cylinder and the reversing cylinder of the pipe switch are provided arranged in parallel branches of one of the reversible pump supplied hydraulic circuits.

In summary the following can be concluded: The invention relates to a device and a method for controlling a two-cylinder thick matter pump comprising delivery pistons that are actuated by means of a hydraulic reversible pump 6 and hydraulic drive cylinders that are controlled by said pump in a push-pull manner. For each pressure stroke, the delivery cylinders 50, 50' are connected to a delivery line 58 by means of a pipe switch 56. At the end of each delivery stroke, a reversal process of the pipe switch 56 and the reversible pump 6 is triggered. The aim of the invention is to achieve a reliable operation even of single-circuit two-cylinder thick matter pumps. To this end, the pipe switch comprises a position transmitter signaling the pivoting position thereof. According to the invention, at least two cylinder switching sensors are provided arranged on the working cylinders at a distance from each other, responsive to the passing pistons of the drive cylinder, and/or a pressure sensor is provided responsive to the pressure course at the high-pressure outlet of the reversible pump. The computer-assisted reversing device comprises a control routine responding to output signals of the position transmitter and to output signals of the cylinder switching sensors and/or the pressure sensors, enabling the programmed control of a control body for adjusting the flow quantity and direction of the reversible pump, and a reversing element arranged in the hydraulic branch of the pipe switch.

The invention claimed is:

1. A device for controlling a thick matter pump with two conveyor cylinders (50, 50') communicating via two end openings (52) in a material supply container (54), operated in counter stroke by a hydraulic reversible pump (6) via hydraulic drive cylinders (5, 5') driven by said pump, with a hydraulically actuated pipe switch (56) provided within the material supply container (54), the inlet side of the pipe switch alternatingly connectable to one of the openings (52) of the conveyor cylinders (50, 50'), freeing the respective other opening of the conveyor cylinders (50, 50'), and on the outlet side the pipe switch is connected with a conveyor conduit (58), wherein the drive cylinders (5, 5') are respectively hydraulically connected at the pump-end with an opening of the reversible pump (6) via one hydraulic line (11, 11'), and wherein the drive cylinders (5, 5') are connected on their other end to each other via an oscillating oil line (12), and further comprising a computer supported reversing device (18) for reversing the reversible pump (6) after the conclusion of each piston stroke, wherein the pump-end hydraulic lines (11, 11') of the drive cylinders and the hydraulic lines (82) of the hydraulically actuated pipe switch (56) are provided in parallel connected branches of one of the reversible pump supplied hydraulic circuits (11', 82; 11), wherein the pipe switch includes a position indicator (80) sensing the pipe switch pivot position, that at least one of (a) at least two cylinder switch sensors are provided spaced apart from each other on the drive cylinders, sensing the pistons of the drive cylinders as they pass by, or (b) the pressure sensor is provided sensitive to changes in pressure at the high pressure output of the reversible pump, and wherein the computer supported reversing device (18) includes a control program responsive on the one hand to the output signal of the position sensor and on the other hand to at least one of (a) the output signal of the cylinder switch sensors and (b) the pressure sensor, for a program-controlled activation of a control element for adjusting at least one of (a) the flow-through amount and (b) the direction of the reversible pump, as well as a reversing element (79) provided in the hydraulic branch (82) of the pipe switch (56), and wherein the computer supported reversing device includes a control routine for the computer controlled adjustment of the flow-through amount and the direction of the reversible pump such that in the case of an impacting piston the pressure supply to an actuating element of the pipe switch is reversed and the conveyance amount supplied by the reversible pump is increased, until the pipe switch has reached a defined intermediate position on its pivot path, and subsequently the conveyance amount supplied by the reversible pump is returned until the pipe switch has reached an end position.

2. The device according to claim 1, wherein the position indicator of the pipe switch is an angle transmitter.

3. The device according to claim 1, wherein the control element is a diagonal disk of the reversible pump.

4. The device according to claim 3, wherein the diagonal disk is adjustable hydraulically or electromechanically.

5. The device according to claim 1, wherein the reversing element is an electromagnetic or mechanically controllable directional valve.

6. A process for controlling a thick matter pump with two conveyor cylinders (50, 50') communicating via two end openings (52) in a material supply container (54), operated in counter stroke by a hydraulic reversible pump (6) via hydraulic drive cylinders (5, 5') driven by said pump, with a hydraulically actuated pipe switch (56) provided within the material supply container (54), on its inlet side alternatingly connectable to one of the openings (52) of the conveyor cylinders (50, 50'), freeing the respective other opening, and on the outlet side connected with a conveyor conduit (58), wherein the drive cylinders (5, 5') are respectively hydraulically connected at the pump-end with an opening of the reversible pump (6) via one hydraulic line (11, 11'), and wherein the drive cylinders (5, 5') are connected on their other end to each other via an oscillating oil line (12), and further comprising a computer supported reversing device (18) for reversing the reversible pump (6) after the conclusion of each piston stroke, wherein during reversing process the pivot position of the pipe switch is measured, wherein during thick matter conveyance the position of the piston in the drive cylinders is monitored and in a terminal segment of each piston stroke the piston speed is slowed down by reducing the conveyance amount supplied by the reversible pump while the piston is conveyed to its end position, wherein in the case of an impacting piston the pressure supply to an actuating element of the pipe switch is reversed and the conveyance amount supplied by the reversible pump in a push-over phase is increased without direction change, until the pipe switch has reached a defined intermediate position on its pivot path, wherein subsequently the conveyance amount supplied by the reversible pump is returned until the pipe switch has reached an end position, and wherein the flow-through direction of the reversible pump is reversed and the pressure supply to the pipe switch is interrupted via a reversing element or is maintained by reversing.

7. The process according to claim 6, wherein in the subsequent flow-through reversal of the reversible pump a hydraulic reversing element connected with the pipe switch is reversed or blocked.

8. The process according to claim 6, wherein the reversible pump in the push-over phase during the reversing process is for a short time controlled to a maximal conveyance amount.

* * * * *